US006205317B1

(12) United States Patent
Song et al.

(10) Patent No.: US 6,205,317 B1
(45) Date of Patent: Mar. 20, 2001

(54) METHOD OF CLEANING INK REMAINING ON PHOTORECEPTOR WEB WHEN ERROR OCCURS IN PRINTER

(75) Inventors: In-young Song, Suwon; Seung-young Byun, Seongnam, both of (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/546,190

(22) Filed: Apr. 10, 2000

(30) Foreign Application Priority Data

Apr. 8, 1999 (KR) ..... 99-12321

(51) Int. Cl.[7] ..... G03G 21/00; G03G 15/00; G03G 15/10; G03G 15/11; G03G 15/16

(52) U.S. Cl. ..... 399/348; 399/9; 399/71; 399/249; 399/251; 399/302; 399/308; 399/345

(58) Field of Search ..... 399/71, 249, 251, 399/237, 348, 349, 357, 308, 307, 302, 297, 345, 9

(56) References Cited

U.S. PATENT DOCUMENTS 5,822,648 * 10/1998 Mohri ..... 399/302 X
5,946,538 * 8/1999 Takeuchi et al. ..... 399/302
6,026,271 * 2/2000 Saitoh ..... 399/308

FOREIGN PATENT DOCUMENTS 5-297739 * 11/1993 (JP) .
9-022236 * 1/1997 (JP) .
9-6146 * 1/1997 (JP) .

* cited by examiner

*Primary Examiner*—Susan S. Y. Lee
(74) *Attorney, Agent, or Firm*—Sughrue, Mion, Zinn, Macpeak & Seas, PLLC

(57) ABSTRACT

A method of cleaning ink remaining on a photoreceptor web when an error occurs in a printer including a development unit for supplying ink to a rotating photoreceptor web to develop an electrostatic latent image formed on the photoreceptor web, a transfer roller for transferring a toner image formed on the photoreceptor web to a sheet of paper, and a cleaning roller installed to clean the transfer roller. When an error occurs, a printing operation is stopped so that the printing cannot be performed. Next, the ink adhering to the photoreceptor web is transferred to the transfer roller by rotating the photoreceptor web a predetermined number of times in a state in which the cleaning roller is separated from the transfer roller and the transfer roller contacts the, photoreceptor web. Then, the ink transferred to the transfer roller is removed in a state in which the cleaning roller contacts the transfer roller. Thus, the time required to remove the polluted ink remaining on the photoreceptor web can be reduced.

8 Claims, 3 Drawing Sheets

METHOD OF CLEANING INK REMAINING ON PHOTORECEPTOR WEB WHEN ERROR OCCURS IN PRINTER

BACKGROUND OF THE INVENTION

1. Field of the Invention

The present invention relates to a method of cleaning the ink remaining on a photoreceptor web when an error occurs in a printer.

2. Description of the Related Art

FIG. 1 shows a conventional liquid electrophotographic printer comprising a photoreceptor web 14, a reset device 15, four optical scanning units 16, four development units 17, a drying unit 18, a transfer unit 20, and a cleaning roller 24. The reset device 15 includes an exposure device 15*a* for removing an electrostatic latent image by emitting light to the photoreceptor web 14, and a charger 15*b* for charging the photoreceptor web 14 to a predetermined level of electric potential. The optical scanning units 16 each scan information of yellow (Y), magenta (M), cyan (C) and black (K) colors to the photoreceptor web 14 circulating by a plurality of rollers 11, 12 and 13. The development units 17 provide ink of yellow (Y), magenta (M), cyan (C) and black (K) colors to the photoreceptor web 14 to develop an electrostatic latent image formed on the photoreceptor web 14 by the optical scanning units 16.

Each of the development units 17 includes an ink supply container 17*f* containing ink to be supplied to the photoreceptor web 14 and a development reservoir 17*e* where the ink dropped from the photoreceptor web 14 is collected and the collected ink can be supplied again to the ink supply container 17*f*. The development reservoir 17*e* is provided with a development roller 17*a* and a brush roller 17*b* for removing the ink adhering to the development roller 17*a*. In the development reservoir 17*e*, there is a squeegee roller 17*c* for separating liquid carrier, which does not contribute to image forming, of the ink supplied to the photoreceptor web 14 from the photoreceptor web 14, and a plate 17*d* for collecting the liquid carrier flowing down along the squeegee roller 17*c* to be stored in the development reservoir 17*e*. As shown in FIG. 2, to prevent liquid carrier from being moved toward both lateral sides of the squeegee roller 17*c* when the liquid carrier is separated from the photoreceptor web 14 by the squeegee roller 17*c*, air injectors 17*g* for injecting air to the photoreceptor web 14 facing the both lateral sides of the squeegee roller 17*c* are provided.

The drying unit 18 is for absorbing and vaporizing the liquid carrier remaining on the photoreceptor web 14. The transfer unit 20 includes a transfer roller 21 and a fusing roller 22 for transferring a toner image formed on the photoreceptor web 14 to a sheet of paper 23 being supplied.

When an error such as paper jam occurs while the paper 23 is supplied to the transfer unit 20 from a paper supply portion (not shown) during a printing operation, a controller (not shown) for controlling the printer interrupts the printing operation until the error is removed. When the printing operation is stopped due to such an error, the ink supplied to the photoreceptor web 14 is hardened and the photoreceptor web 14 is polluted. Thus, after the error is removed, the remaining ink should first be removed before the printing continues.

Previously, to remove the ink remaining on the photoreceptor web 14, the photoreceptor web 14 is rotated several times in a state in which the cleaning roller 24 is in contact with the transfer roller 21 contacting the photoreceptor web 14. However, as the surface of the transfer roller 21 is continuously cleaned by the cleaning roller 24, a transfer rate of ink from the photoreceptor web 14 to the transfer roller 21 is lowered when a large amount of ink remains on the surface of the transfer roller 21. As a result, the photoreceptor web 14 must be rotated several times to clean the photoreceptor web 14 within an acceptable amount of remaining ink so that the cleaning work takes much time.

SUMMARY OF THE INVENTION

To solve the above problems, it is an objective of the present invention to provide a method of cleaning the ink remaining on the photoreceptor web when an error occurs in a printer so that the time needed for a cleaning operation to remove a pollutant remaining on the photoreceptor web can be reduced.

Accordingly, to achieve the above objective, there is provided a method of cleaning ink remaining on a photoreceptor web when an error occurs in a printer including a development unit for supplying ink to a circulating photoreceptor web to develop an electrostatic latent image formed thereon, a charger for charging the photoreceptor web to a predetermined level of electric potential, a transfer roller for transferring a toner image formed on the photoreceptor web to a sheet of paper, a drying unit for absorbing and vaporizing liquid carrier remaining on the photoreceptor web, and a cleaning roller installed to clean the transfer roller. The method comprises the steps of stopping a print work when an error occurs so that the print work cannot be performed, transferring the ink adhering to the photoreceptor web to the transfer roller by circulating the photoreceptor web predetermined times in a state in which the cleaning roller is separated from the transfer roller and the transfer roller contacts the photoreceptor web, and removing the ink transferred to the transfer roller in a state in which the cleaning roller contacts the transfer roller when the ink transferring step is completed.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
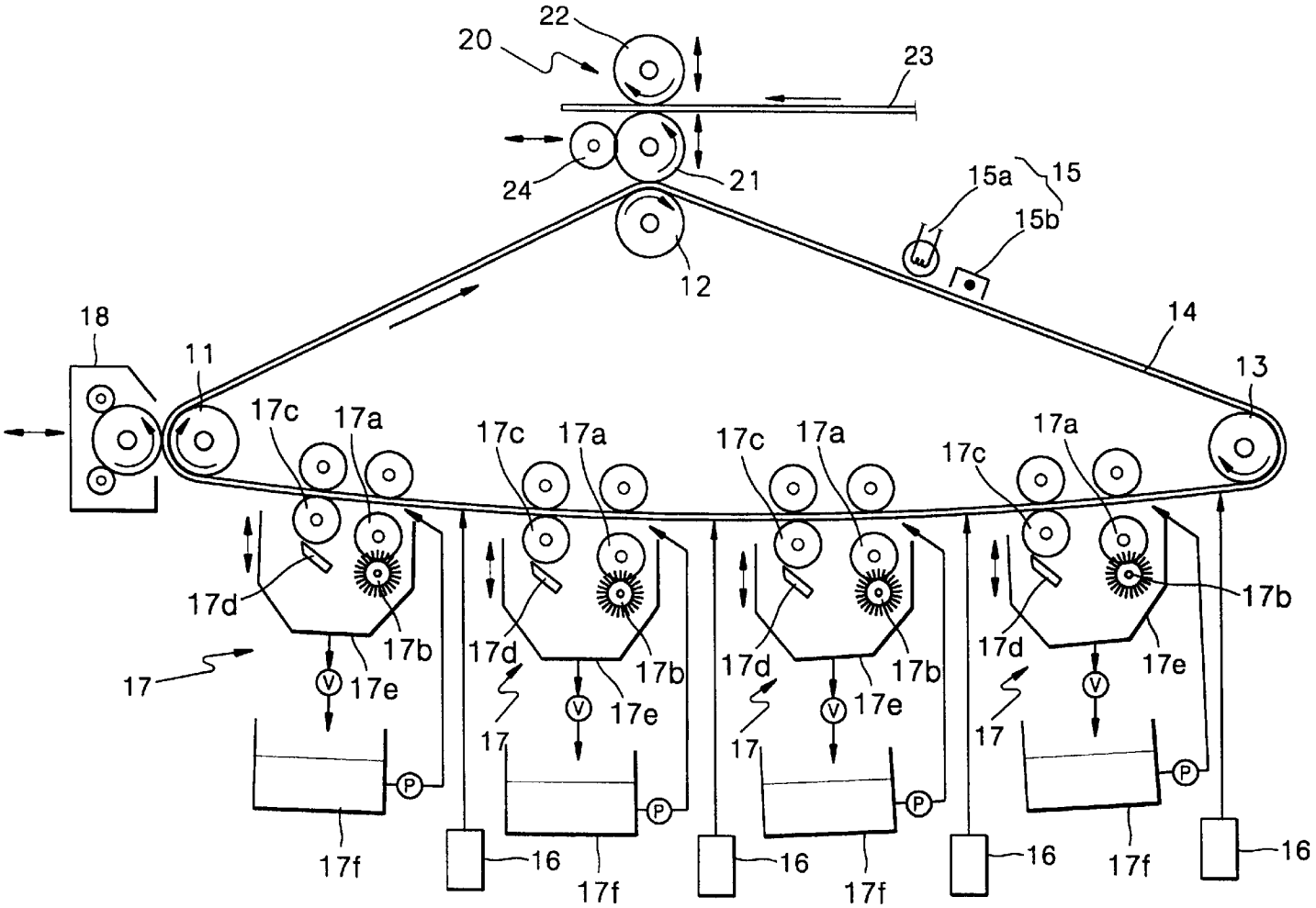
FIG. 1 is a view showing a conventional liquid electrophotographic printer.
Figure 2:
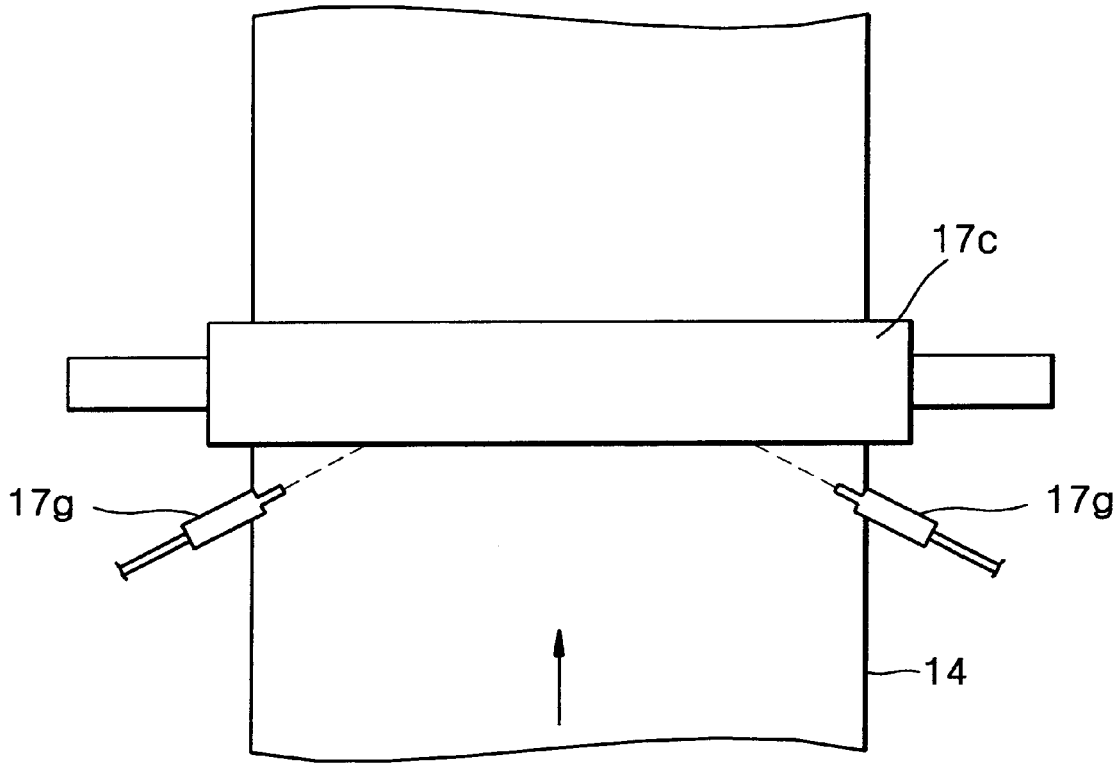
FIG. 2 is a plan view showing the air injector adopted in the printer of FIG 1.
Figure 3:
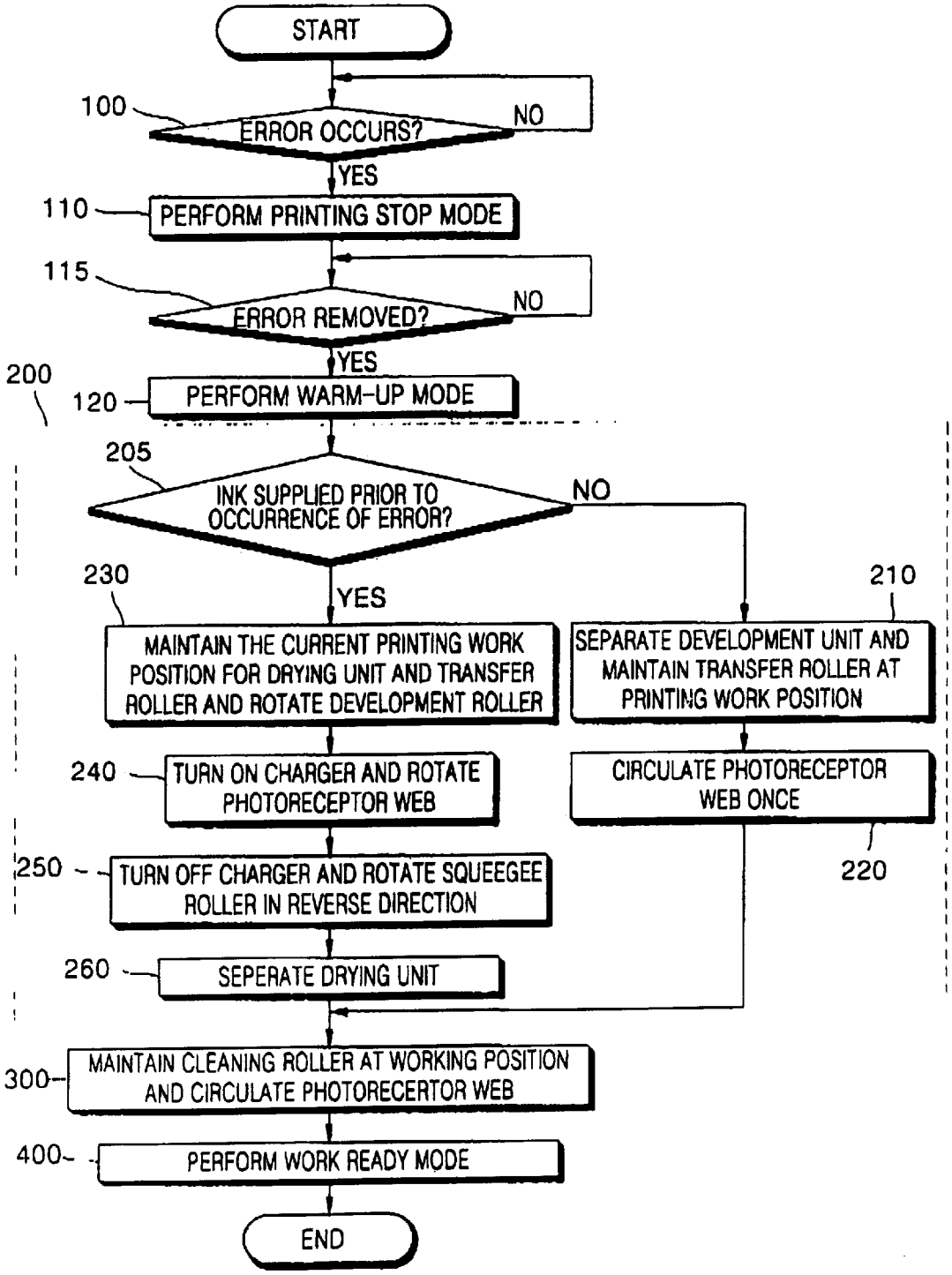
FIG. 3 is a flow chart for explaining a process of cleaning ink remaining on the photoreceptor web when an error occurs in a printer according to a preferred embodiment of the present invention.

The preferred embodiment of the present invention is applied to the printer shown in FIG. 1. Referring to FIG. 3, it is initially determined whether an error has occurred (step 100). The error may be a paper jam and/or other errors of structural devices which disable a normal print operation. The determination of an error in the printer is performed by a controller (not shown) for controlling each device of the printer.

When it is determined that an error has occurred, the controller performs a printing stop mode operation to interrupt the printing operation (step 110). Preferably, in the printing stop mode, the rotation of the photoreceptor web 14 is stopped, the development unit 17 is maintained in the current position at which a development operation is performed during a printing operation, the air injector 17*g* continues to inject air, and the transfer roller 21, the fusing roller 22, the drying unit 18 and the cleaning roller 24 are separated from the positions at which the printing operation is performed. That is, the transfer roller 21 is separated from the photoreceptor web 14, the fusing roller 22 is separated from the transfer roller 21, and the cleaning roller 24 is separated from the transfer roller 21. Further, in the printing stop mode, information regarding whether ink had been supplied from the development unit 17 to the photoreceptor web 14 prior to the occurrence of the error is obtained and stored in a memory (not shown). When the printing stop mode operation is completed, the printer waits until the error is removed (step 115).

When it is determined that the error has been removed, a warm-up mode operation is performed in which the transfer roller 21, the fusing roller 22 and the drying roller 18 are heated to a set target temperature (step 120). Next, a first cleaning mode operation (step 200) and a second cleaning mode operation (step 300) are sequentially performed.

First, in the first cleaning mode operation, while the cleaning roller 24 is separated from the transfer roller 21, the transfer roller 21 is allowed to contact the photoreceptor web 14 and the transfer roller 21 and the photoreceptor web 14 are rotated to transfer the ink remaining on the photoreceptor web 14 to the transfer roller 21.

Initially, it is determined whether the ink had been supplied to the photoreceptor web 14 prior to when the error occurred, in the printing stop mode, by reading the information stored on the memory, the development unit 17 is moved from a development position to a work ready position in the first cleaning step (step 210) and the photoreceptor web 14 is rotated predetermined times so that the transfer roller 21 and the photoreceptor web 14 can contact each other (step 220). Here, the work ready position of the development unit 17 means that the development unit 17 is separated a predetermined distance from the photoreceptor web 14.

When it is determined that the ink had been supplied to the photoreceptor web 14 prior to when the error occurred (step 205), the first cleaning mode operation 200 includes a first sub-step and a second sub-step. In the first sub-step, the development unit 17, the drying unit 18 and the transfer roller 21 are maintained at a printing position. Here, the printing position means a work position of each device when printing is performed, that is, the development unit 17, the drying unit 18, and the transfer roller 21 are in contact with the photoreceptor web 14, as shown in FIG. 1. In the first sub-step, the development roller 17*a* existing in the development unit 17 in the print work position is rotated (step 230). Simultaneously, in the first substep, the charger 15*b* is turned on and driven for a predetermined time to rotate the photoreceptor web 14 to lower an electric combining force of the charged ink remaining on the photoreceptor web 14 with respect to the photoreceptor web 14 (step 240).

Next, in the second sub-step, the charger 15*b* is turned off and the development unit 17 is driven for a predetermined time to collect the ink remaining on the photoreceptor web 14 into the development unit 14 through the squeegee roller 17*c* and the plate 17*d* while the photoreceptor web 14 circulates (step 250). Here, the circulation speed of the photoreceptor web 14 is preferably less than that of the photoreceptor web 14 during printing. The squeegee roller 17*c* is rotated in reverse direction, that is, in the direction opposing the circulation direction of the photoreceptor web 14.

Next, the drying unit 18 is separated from the photoreceptor web 14 and the photoreceptor web 14 is rotated predetermined times (step 260). The second cleaning mode is performed after the first cleaning mode, in which the ink remaining on the photoreceptor web 14 is transferred to the transfer roller 21, is completed (step 300). In the second cleaning mode, in a state in which the cleaning roller 24 contacts the transfer roller 21 contacting the photoreceptor web 14, the photoreceptor web 14 is circulated predetermined times and the ink transferred to the transfer roller 21 is moved to the cleaning roller 24 and thus removed.

When performing of the second cleaning mode is completed, a work ready mode is performed. In the work ready mode, the cleaning roller 24 is separated from the transfer roller 21 and the transfer roller 21 is separated from the photoreceptor web 14 and the rotation of the photoreceptor web 14 is stopped (step 400).

According to the cleaning method of the present invention, in the first cleaning mode operation, only the photoreceptor web 14 and the transfer roller 21 are rotated so that an ink transfer rate from the photoreceptor web 14 to the transfer roller 21 increases. The polluted ink transferred to the transfer roller 21 through the first cleaning mode is removed by the cleaning roller 24 in the second cleaning mode operation. Thus, the polluted ink remaining on the photoreceptor web 14 can be effectively removed and the time needed for the cleaning work can be saved.

As described above, in the method of cleaning the ink remaining on the photoreceptor web when an error occurs according to the present invention, the polluted ink remaining on the photoreceptor web can be effectively removed and the time needed for the cleaning work can be reduced.

What is claimed is:

1. A method of cleaning ink remaining on a photoreceptor web when an error occurs in a printer including a development unit for supplying ink to a rotating photoreceptor web to develop an electrostatic latent image formed on the photoreceptor web, a charger for charging the photoreceptor web to a predetermined level of electric potential, a transfer roller for transferring a toner image formed on the photoreceptor web to a sheet of paper, a drying unit for absorbing and vaporizing liquid carrier remaining on the photoreceptor web, and a cleaning roller installed to clean the transfer roller, the method comprising the steps of:

(a) stopping a printing operation when an error occurs during the printing operation;

(b) transferring the ink adhering to the photoreceptor web to the transfer roller by rotating the photoreceptor web a predetermined number of times in a first state in which the cleaning roller is separated from the transfer roller and the transfer roller contacts the photoreceptor web; and (c) removing the ink transferred to the transfer roller in a second state in which the cleaning roller contacts the transfer roller when step (b) is completed.

2. The method as claimed in claim 1, wherein step (a) comprises stopping rotation of the photoreceptor web, maintaining a current development work position of the development unit, and separating the drying unit and the roller unit from the transfer photoreceptor web.

3. The method as claimed in claim 2, wherein the development unit comprises:

a development roller installed to face the photoreceptor web;

a squeegee roller for separating the liquid carrier remaining on the photoreceptor web proceeding after the development roller; and an air injector for injecting air to the photoreceptor web facing both lateral sides of the squeegee roller to prevent the liquid carrier from moving through the both lateral sides of the squeegee roller, and wherein step (a) further comprises continuously injecting air from the air injector to the photoreceptor web.

4. The method as claimed in claim 1, wherein step (a) further comprises determining whether the ink had been supplied from the development unit to the photoreceptor web prior to the occurrence of the error.

5. The method as claimed in claim 4, wherein step (b) further comprises, when an error occurs and it is determined that the ink had not been supplied to the photoreceptor web in step (a), moving the development unit to a work ready position from a development work position and allowing the transfer roller to contact the photoreceptor web to rotate the photoreceptor web.

6. The method as claimed in claim 4, wherein, when an error occurs and it is determined that the ink had been supplied to the photoreceptor web in step (a), step (b) further comprises:

(a1) allowing the drying unit and the transfer roller to contact the photoreceptor web and rotating the photoreceptor web a predetermined number of times while rotating a development roller in the development unit in a state in which the development unit is maintained at a development work position; and (a2) separating the drying unit from the photoreceptor web and rotating the photoreceptor web a predetermined number of times.

7. The method as claimed in claim 6, wherein step (a1) further comprises driving the charger for a predetermined period of time.

8. The method as claimed in claim 1, further comprising:

(d) separating the cleaning roller from the transfer roller, separating the transfer roller from the photoreceptor web and stopping rotation of the photoreceptor web; and (e) returning the printer to a work ready mode.

* * * * *